US005342014A

United States Patent [19]

Wilson

[11] Patent Number: 5,342,014

[45] Date of Patent: Aug. 30, 1994

[54] DISPLAY SYSTEM

[76] Inventor: Malcolm A. Wilson, P.O. Box 445, Hyannis, Mass. 02601

[21] Appl. No.: 150,541

[22] Filed: Nov. 10, 1993

Related U.S. Application Data

[63] Continuation of Ser. No. 940,592, Sep. 4, 1992, abandoned.

[51] Int. Cl.[5] ..... A47G 1/16

[52] U.S. Cl. ..... 248/476; 248/490; 248/495; 248/497

[58] Field of Search ..... 248/476, 475.1, 497, 248/495, 490, 489

[56] References Cited

U.S. PATENT DOCUMENTS

| | | | |
|---|---|---|---|
| 394,144 | 12/1888 | Sword | 248/496 |
| 722,311 | 3/1903 | Magerhans | 248/489 X |
| 904,690 | 11/1908 | Francis | 248/496 |
| 972,579 | 10/1910 | Shepard | 248/496 |
| 1,107,686 | 8/1914 | Mehrmann | 248/495 |
| 1,196,936 | 9/1916 | Elsass et al. | 248/495 |
| 1,220,021 | 3/1917 | Smyrk | 248/495 X |
| 1,242,309 | 10/1917 | Backerud | 248/496 |
| 1,357,280 | 11/1920 | Dulle | 248/490 |
| 3,804,360 | 4/1974 | Stecker | 248/489 |
| 4,222,544 | 9/1980 | Crowder | 248/495 |

*Primary Examiner*—Rinaldi I. Rada
*Attorney, Agent, or Firm*—Cesari and McKenna

[57] ABSTRACT

A display system for art work includes a molding bracket attached to the top of a wall and a plurality of vertical display units which are attached to and slidable along the molding bracket. Support brackets from which the art works are hung attach to the vertical display units and move vertically along a central track. Preferably, the art work is hung using support bars, which are shaped to fit into the support brackets. Each of the support bars includes a center recess which matches the shape of a slot in the support brackets. When the support bar engages the support bracket, the recess and the slot mate to lock the art work against rotation. The molding bracket and the vertical display units each include a central track, along which the attached units or support brackets move.

9 Claims, 3 Drawing Sheets

DISPLAY SYSTEM

This application is a continuation of U.S. application Ser. No. 07/940,592, filed Sep. 4, 1992, now abandoned.

FIELD OF THE INVENTION

The invention relates generally to a system for displaying paintings or other hanging works of art, and more particularly, to a display system which readily allows rearrangement of the art works without re-hanging.

BACKGROUND OF THE INVENTION

Art museums and commercial art galleries display paintings and other hanging works of art in arrangements which may change yearly, monthly or even daily. In a museum, for example, works which are on loan or in a traveling exhibit may be temporarily displayed and permanent works rearranged to accommodate them. In a commercial art gallery, the works may require rearrangement as particular pieces are sold, or as new pieces are acquired. Such re-arrangement, using prior picture-hanging hardware, requires drilling holes in the gallery walls, to accommodate the re-location of picture hooks or similar hardware. Accordingly, each time a painting is moved to a new location, a new hole is drilled for the associated picture-hanging hardware and a hole left at the previous location.

Eventually, there are so many holes in the walls that the paintings cannot be rearranged to adequately cover them. The holes must thus be filled-in and the wall repainted, before the works can be displayed in a new arrangement. The filling-in of the holes and the re-painting of the gallery walls is both time consuming and expensive.

Re-arranging displays is not easily done in situations in which molding hooks and wires are used to hang the works, instead of hooks fastened directly to the walls. While no new holes need to be drilled to re-locate a particular painting, re-stringing may be required if the painting is to rest higher or lower on the wall. Thus re-arrangement of such a display is not a particularly easy task. Moreover, molding hooks are not particularly suited for use in galleries in which works are often hung in vertical alignment at varying heights. What is needed is a system for displaying art work which allows both vertical and horizontal rearrangement of the works without the drilling of holes for hardware or the re-stringing of the paintings.

SUMMARY OF THE INVENTION

The invention is a system for displaying hanging art work which includes molding brackets, which run horizontally along the tops of the gallery walls, and vertical display units which attach to the molding brackets and support the hanging works. The vertical display units are attached to and slide along central tracks in the molding brackets. To reposition a painting horizontally, the display units supporting the painting are pushed or pulled to the desired position and secured in place. The display units each include a central track on which one or more painting support brackets are positioned. The painting support brackets move along these tracks to reposition the paintings vertically.

The painting support brackets are essentially J-shaped, and paintings are strung or hung from the lower, curved end. Preferably, a painting support bar is attached directly to the frame of each of the paintings and a painting is hung by sliding the support bar into the curved end of the support bracket. Each support bar includes a recess which is shaped to fit precisely around the lower end of the support bracket, so that it essentially "locks" the painting against rotation when the bar and holder are engaged. A painting may be moved from one display unit to another by sliding the painting support bar out of its current support bracket and sliding it into a support bracket which is attached to the other display unit.

Only the molding brackets are attached to the gallery walls, and thus, the vertical display units and the paintings themselves may readily be moved horizontally and vertically to any desired location, without the drilling of new holes for hanging hardware, and/or the re-stringing of the paintings.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1:
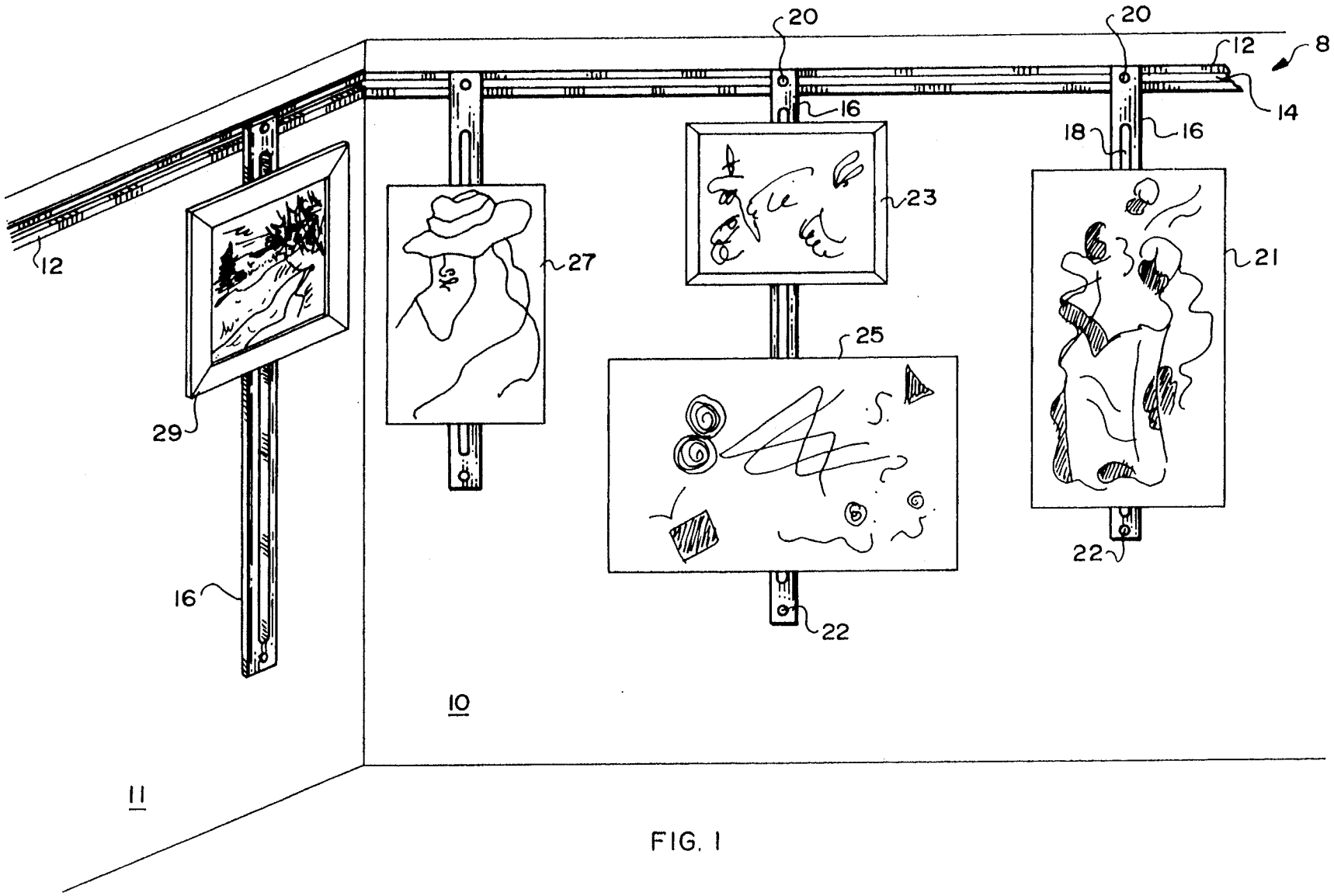
FIG. 1 depicts an arrangement of art work displayed on a display system constructed in accordance with the invention.

As illustrated in FIG. 1, a display system 8 attaches to walls 10 and 11 so as to display various paintings 21, 23, 25, 27 and 29. The display system 8 includes molding brackets 12 which run horizontally along the top of walls 10 and 11 and movable vertical display units 16 from which the paintings are hung. Each vertical display unit 16 attaches to one of the molding brackets 12 with a screw 20. The screw slides within central tracks 14 in the molding brackets 12, to move the vertical display unit 16 in the horizontal direction. The central tracks 14 are preferably recessed, such that nuts (not shown) which hold the screws 20 in place are captive within the recess, and thus, do not turn when the associated screws 20 are loosened to slide the displays.

Each vertical display unit 16 includes a vertical track 18 in which one or more printing support brackets (not shown) slide to position the paintings vertically. More than one painting may be hung on a vertical display unit 16, as illustrated by the arrangement of pictures 23 and 25. Each vertical display unit 16 includes a screw hole 22, which may be used to attach additional vertical display units, as necessary.

The molding brackets 12 and vertical display units 16 may be constructed out of wood, plastic or any material which is strong enough to support the weight of the paintings.

If a painting, for example, painting 23, is removed from a display unit 16, the remaining painting 25 on the unit 16 may be moved along the track 18, to position the painting 23 higher on the wall 10. Alternatively, painting 25 may be moved down along the track 18 to a position which is lower on wall 10, and another painting, for example, painting 29, may be added to the display unit, by hanging it from the support bracket from which painting 23 was hung. The support brackets are described in more detail below with reference to FIGS. 2–3. All of this rearranging is done without drilling any holes in gallery walls 10 or 11.

Figure 2:
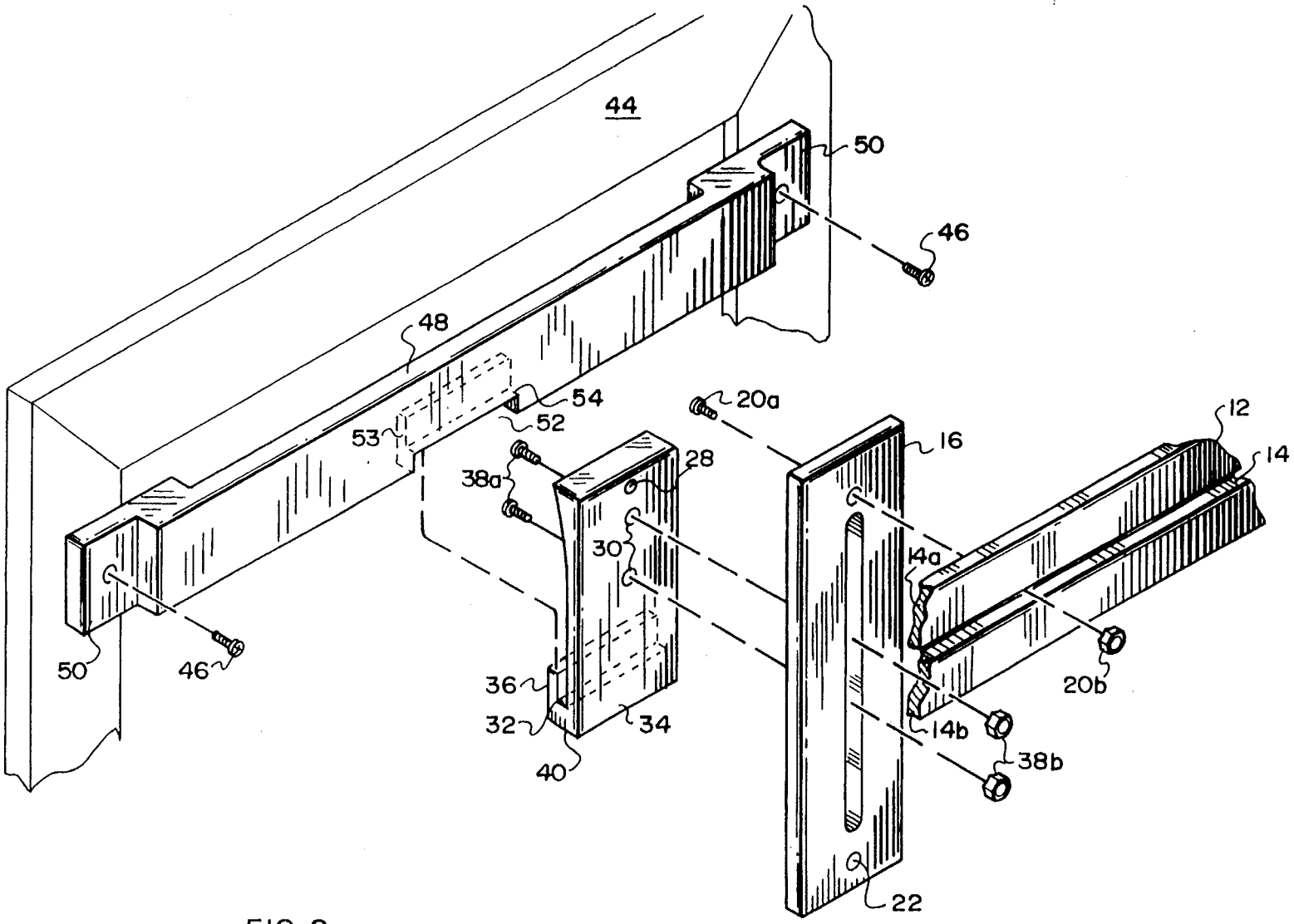
FIG. 2 is an exploded rear view of the display system.

FIG. 2 illustrates how the various system components attach to one another. The vertical display unit 16 attaches to the molding bracket 12 with a screw 20*a*, which extends through a hole 24 in the vertical display unit, through the central track 14 of bracket 12, and is secured in place by a nut 20*b*. The nut 20*b* rests in the recessed track 14, such that it touches top and bottom walls 14*a–b* of the recess and does not turn when the screw 20*a* is loosened to allow the vertical display unit to move along the track 14 to a desired location or tightened to secure the unit 16 in place. As necessary, display units may be easily added to or removed from the system using the screws 20*a*.

A painting support bracket 26 is attached to the vertical display unit 16 with screws 38*a* which extend through holes 30 in the support bracket 26 and through the vertical track 18 of display unit 16, and are secured in place with nuts 38*b*. The screws 38*a* are loosened to allow the support brackets to move vertically along the track 18 to a desired position, and tightened to secure the support bracket in place. Support brackets may be added to display units or removed from the units, as necessary, using the screws 38*a* and nuts 38*b*.

The painting support bracket 26 is J-shaped, such that a painting can be hung from the lower, curved end. The lower end includes a slot 32, formed by a back wall 34, a bottom wall 40 and a partial-height front wall 36. The top portion of the back wall 34 is angled, such that the top of the back wall 34 juts out farther from the gallery wall than the mid-section of the back wall 34, when the support bracket is in place on a display unit 16. The angled back wall 34 acts essentially as a guide to direct a painting support bar 42 into place in slot 32.

The painting support bar 42 attaches to the back-side of a painting frame 44 with screws 46. The painting support bar 42 includes an elongated mid-section 48 and tabs 50, which extend from either end of the mid-section 48 toward and along the frame 44. The elongated mid-section 48 includes, at its mid-point, a recess 52, which is shaped to fit securely into the slot 32 of the support bracket 26 and lock the frame 44 against rotation. The recess 52 is L-shaped, with dimensions which mirror those of the slot 32. When the support bar 42 slides into the slot 32, the elongated section 53 of recess 52 fits over the partial height wall 36, and the shorter front section 54 of recess 52 fits over the bottom wall 40 of slot 32, with the sides 54*b* of the front section 54 extending down along the sides of the bottom wall 40. The support bar 42 is thus essentially locked into place, such that it can not move within or inadvertently slide out of the slot 32.

To hang a painting which has attached to it a support bar 42, one positions the painting slightly above the support bracket and slides the support bar along the angled back wall 34 of the bracket and into the slot 32. As discussed above, the respective shapes of the slot 32 and the recess 52 of the support bar 42 mate, to prevent rotation of the frame 44. Alternatively, the painting may be hung from the support bracket 26 with picture wire, by slipping the wire into the slot 32. When the painting is to be removed from display, it is pushed upward until the support bar 42 or wire disengages from the slot 32.

Figure 3:
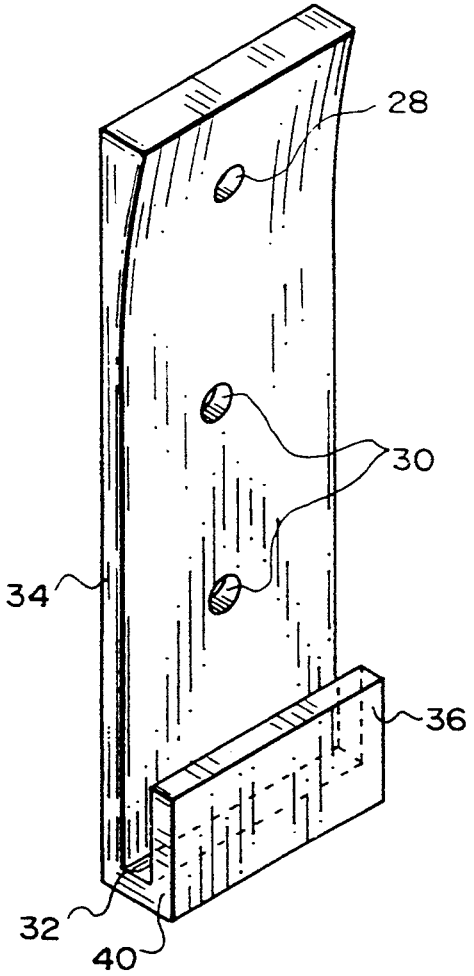
FIG. 3 is a front view of a painting support bracket illustrated in FIG. 2.

FIG. 3 is a front view of the painting support bracket 26. The support bracket 26 includes the slot 32 formed by front wall 36, bottom wall 40 and a back wall 34, two screw holes 30 through which screws 38 extend to attach the holder to a vertical display unit 16 and a third screw hole 28 through which a screw may be driven to attach the bracket 26 directly to a gallery wall. Preferably, the top portion of the wall 34 is thicker than the bottom portion, and the screw hole 28 is angled such that a screw driven through the screw hole 28 enters the wall with its head raised above its point end.

The display system described herein can be used to display paintings in a number of different arrangements, without the redrilling of holes for picture holding hardware. Instead, the paintings are moved horizontally and vertically along the walls, respectively, by sliding vertical display units along tracks in molding brackets which are permanently installed along the tops of the gallery walls, and sliding support brackets and paintings hung therefrom along tracks in the vertical display units.

The foregoing description has been limited to a specific embodiment of this invention. It will be apparent, however, that variations and modifications may be .made to the invention, with the attainment of some or all of its advantages. Therefore, it is the object of the appended claims to cover all such variations and modifications as come within the true spirit and scope of the invention.

What is claimed is:

1. A display system for displaying hanging art work on walls, the display system comprising:

A. one or more horizontal brackets for attachment to the walls, each of the horizontal brackets including a recessed track with a center opening;

B. one or more vertical display units for attachment to the horizontal brackets, each of the vertical display units including:

i. a display unit attachment mechanism, which fits into and is retained within the recessed track of a horizontal bracket and extends outwardly from the track through the center opening, the attachment mechanism sliding horizontally along the track to position the vertical display unit in a desired position, and ii. an elongated vertical member with an integral track, the elongated vertical member removably attaching to the display unit attachment mechanism and hanging vertically therefrom, and c. one or more support mechanisms attached to the track of the vertical member, each support mechanism supporting one art work and moving independently along the track to position the work vertically on the vertical member, each of the support mechanisms including:

i. attachment means for removably attaching to and slideably moving within the track of the vertical member, and ii. a J-shaped member for supporting an art work suspended therefrom, the J-shaped member attaching to and moving with the attachment means to adjust the vertical position of the art work along the track of a vertical member.

2. The display system of claim 1, wherein each J-shaped member includes a top end and a bottom end, with the bottom end directed upwardly to support a hanging work.

3. The display system of claim 2, wherein each support mechanism further includes a support bar which has a first end and a second end and a center span between the first and second ends, the ends attaching to an art work and the center span slideably engaging the bottom end of the J-shaped member, to suspend the art work attached to the first and second ends from the bottom end of the J-shaped member.

4. The display system of claim 3, wherein the center span of the support bar includes a recess which is shaped to mate with the bottom end of the J-shaped member.

5. The display system of claim 2, wherein the top end of the J-shaped member is sloped to guide the support bar into engagement with the bottom end.

6. The display system of claim 2, wherein the top end of the J-shaped member angles outwardly from the bottom end, and includes an opening into which a screw may be inserted to attach the J-shaped member directly to a wall.

7. The display system of claim 6, wherein the opening in the top end of the J-shaped member is angled, to direct a screw inserted therein into the wall at an angle.

8. The display system of claim 1, wherein:

a. the elongated vertical member consists of two sides which are joined together at their ends and a hollowed middle section which forms the integral track; and b. the attachment means consists of one or more screws which extend through and move slideably within the hollowed middle section.

9. A display system for displaying hanging art work on walls, the display system comprising:

A. one or more horizontal brackets for attachment to the walls, each of the horizontal brackets including a recessed track with a center opening;

B. one or more vertical display units for attachment to the horizontal brackets, each of the vertical display units including, i. a display unit attachment mechanism, which fits into and is retained within the recessed track of a horizontal bracket and extends outwardly from the track through the center opening, the attachment mechanism sliding horizontally along the track to position the vertical display unit in a desired position, and ii. an elongated vertical member with an integral track, the elongated vertical member removably attaching to the display unit attachment mechanism and hanging vertically therefrom, and C. a plurality of support mechanisms attached to the track of the vertical member, each support mechanism supporting one art work and moving independently along the track to position the work vertically on the vertical member, each of the support mechanisms including:

i. attachment means for removably attaching to and slideably moving within the track of the vertical member, and ii. a J-shaped member for supporting an art work suspended therefrom, the J-shaped member attaching to and moving with the attachment means to adjust the vertical position of the art work along the track of a vertical member.

* * * * *